US005522757A

United States Patent [19]

Ostrowski

[11] Patent Number: 5,522,757

[45] Date of Patent: Jun. 4, 1996

[54] INFLATABLE RECREATIONAL PUNCHBALL

[76] Inventor: Michael J. Ostrowski, 71 Lothrop's La., West Barnstable, Mass. 02668

[21] Appl. No.: 427,343

[22] Filed: Apr. 24, 1995

Related U.S. Application Data

[63] Continuation-in-part of Ser. No. 239,035, May 6, 1994, abandoned.

[51] Int. Cl.[6] ..... A63H 3/06

[52] U.S. Cl. ..... 446/220; 446/267; 446/486; 273/58 BA; 273/58 H; 273/58 C; 482/88

[58] Field of Search ..... 273/58 BA, 58 C, 273/58 H, 413, 414; 446/4, 220–226, 267, 486; 482/83, 86, 88

[56] References Cited

U.S. PATENT DOCUMENTS

| | | | |
|---|---|---|---|
| 811,546 | 2/1906 | Conroy | 482/86 |
| 923,379 | 6/1909 | Selfe | 482/86 |
| 1,898,817 | 2/1933 | Dole | 273/58 C |
| 2,081,059 | 5/1937 | Mitchell | 273/58 C |
| 2,210,024 | 8/1940 | Cayo | 482/88 |
| 2,612,924 | 10/1952 | Cunningham | 482/86 |
| 4,130,276 | 12/1978 | Tricarico | 482/88 |
| 4,834,382 | 5/1989 | Spector | 273/58 BA |
| 4,944,363 | 7/1990 | Osher et al. | 446/267 |
| 5,135,222 | 8/1992 | Spector | 446/220 |

FOREIGN PATENT DOCUMENTS

| | | | |
|---|---|---|---|
| 18403 | of 1909 | United Kingdom | 482/86 |
| 261614 | 6/1929 | United Kingdom | 273/58 H |
| 473788 | 10/1937 | United Kingdom | 482/83 |

*Primary Examiner*—Mickey Yu
*Assistant Examiner*—Jeffrey D. Carlson
*Attorney, Agent, or Firm*—Richard P. Crowley

[57] ABSTRACT

An inflatable recreational ball with an outer covering formed of a stretchable, flexible fabric material, which when fully expanded assumes a desired ball configuration, said covering having a small opening therein to permit the insertion into the outer covering of an inflatable balloon in its uninflated state. The balloon is formed of a thin elastic material having an air passage stem which projects through the opening, and which permits inflation of the balloon within the outer covering to cause the balloon on full inflation to engage the inner surface and to stretch slightly the outer covering to a desired generally spherical configuration. The ball includes a band or loop on the covering to secure an elastic element to the ball and preferably an elastic loop element is secured to the band and adapted to be held with the hand of a recreational ball user. In use, the repeated short movement of the hand of the user repeatedly bounces the recreational punch ball against the user's hand, utilizing the high bounce properties of the recreational punch ball and the elastic element secured to the ball.

17 Claims, 1 Drawing Sheet

INFLATABLE RECREATIONAL PUNCHBALL

REFERENCE TO PRIOR APPLICATION

This application is a continuation-in-part of U.S. patent application Ser. No. 08/239,035, filed May 6, 1994 now abandoned.

BACKGROUND OF THE INVENTION

Pneumatic or inflatable play balls are commonly employed and used by children or even adults for recreational purposes. One type of inflatable play ball is described in U.S. Pat. No. 4,834,382 issued May 30, 1989. This patent describes a pneumatic play ball for use by a child having a fixed-shape outer casing formed of a non-stretchable, flexible, fabric material and an internal, mouth-inflatable bladder in the form of a balloon, wherein the stem of the balloon extends out from a casing opening and after inflation the casing opening is closed with a separate closure. The inflated play ball is fully encased by the outer casing; no portion thereof is extruded therefrom, and the ball is inflated to provide for high bounce in use for recreational purposes.

It is desired to provide for an inflatable recreational ball for use by adults and children, particularly a ball which may be employed in a regular manner as an inflatable ball, and optionally may be employed by the operator bouncing the ball, wherein the inflatable play ball may be bounced repeatedly against the hand of the user, with or without an elastic loop handle means.

SUMMARY OF THE INVENTION

This invention relates to a fluid inflatable recreational ball for recreational purposes and particularly an inflatable punching hand air ball.

The inflatable recreational ball, or particularly a punch ball of the invention, comprises a recreational ball which has an outer covering formed of a stretchable, flexible, fabric material, which when fully expanded assumes the desired recreational ball configuration, typically employed as a punch ball, as a generally spherical ball configuration, said covering having a small first opening thereon to permit the insertion therein into the covering of an inflatable balloon in its uninflated state. The recreational ball includes a balloon formed of a thin, elastic material, such as rubber, and typically being mouth-inflatable or needle inflatable, and having an air passage, such as a flat, sealed section with a sealed opening for the insertion of a needle for pumping in air or in a simpler form a balloon with a stem at one end thereof, and optionally at the other end, generally opposite to the stem, an outwardly extending enclosed tip, wherein the stem projects through the front or other opening in the outer covering to permit inflation of the balloon within the outer covering to cause the balloon on full inflation to engage and slightly stretch the outer covering to the desired recreational ball configuration, and when fully inflated to impart high bounce properties to the recreational ball. The inflated balloon with the stem sealed or passage closed, such as tied with a balloon stem, with the inflated balloons substantially fully encased by the outer stretched covering forms a punchable type recreational or play ball.

Where a stem type balloon is used, the stem may extend for inflation purposes out of a first or opposite second opening in the covering and then be tied or sealed and left in the opening or folded or tucked between the outer covering and the balloon. Where a non-stem needle-inflatable balloon or bladder is used, the balloon is inflated by inserting a needle into a recessed seal and pumping in air. The invention also includes the use of water to fill a balloon, typically of smaller size, e.g. 3–6 inches in diameter, as a punching or throwing ball.

The recreational ball includes a securing means to secure an elastic element, such as an elastic loop-type element, to the ball, and typically comprises a band, for example, of stretchable fabric extending near or across the first or second opening or anywhere on the outer covering. The recreational ball also includes an elastic-type element, like a loop element, such as a rubber band, and typically enclosed within a stretchable fabric, which may be the same or different than the fabric of the outer covering. The elastic element may be a single strand rubber band or in loop form and includes a woven, stretchable elastic fabric cover. When the elastic element is secured to the securing means, the elastic element, in particularly the loop element, is adapted to be held about the hand of a user, whereby the user upon insertion of the hand within the loop element or by otherwise grasping the elastic means, may repeatedly bounce the inflated recreational ball typically against his hand, providing for recreational purposes and as a stress reliever for adults.

The outer covering may be formed of a wide variety of stretchable fabric materials to provide proper expansion for the inner balloon, so that the outer covering snugly fits and forms a non-wrinkle, taut outer covering. The fabric may be composed of stretchable fibers, either alone or in various combinations. The fibers may be composed of, for example, polyamides, like various nylons, spandex fibers or combinations thereof, or other polymeric natural or synthetic fibers having similar stretchability and elasticity.

The recreational ball has an outer cover formed of a flexible plastic material, typically such flexible plastic material, such as Lycra® or a Lycra® fabric blend, (Lycra® is a registered trademark of E.I. Demours DuPont & Co., Inc. for a spandex fiber formed from a continuous mono-filament), such as, for example, a nylon-Lycra® blend or more typically solely Lycra® itself. Generally, the outer cover is formed by sewing or otherwise securing together separate pieces of the stretchable fabric material, for example in arcuate, trapezoidal pieces which are secured at each end, to form, for example, a generally spherical punch ball form. However, it is recognized that other desirable ball forms can be employed in the practice of the invention. The employment of a stretchable flexible fabric material in combination with an inflatable balloon provides for very high bounce characteristics, a taut or tight covering at all times over the inflated balloon in the recreational ball. The outer cover has a small stem opening which may vary in size and shape, but generally is of sufficient size and shape, if not more, to permit the insertion into the outer covering of an inflatable balloon to provide an opening of the outwardly extending stem of the balloon so that the balloon may be inflated, typically but not solely, by mouth inflation.

The inflatable balloon as provided is formed of a thin, rubber, fluid-expandable-type material which is formed to mimic generally the selected configuration of the outer covering of the construction, and so as to slightly stretch the covering in the fully inflated state to provide very high bounce characteristics to the combination of the inflated balloon and the stretchable outer covering. A stem balloon typically has a water, air or gas passage short stem which will project through the stem opening of the outer cover to permit the user to fully inflate the balloon within the covering, on a full inflation to engage, contact and slightly stretch the outer covering. Thereafter, the stem section may be clipped or otherwise tied or secured to prevent the outward escape of the fluid, and then may be tucked to one or the other side between the inflated balloon and outer covering. Generally, the stem-type balloons have a slightly extended tip area generally axially aligned and opposite the stem passageway of the balloon. In one embodiment it is desired to provide for an additional or second opening in the outer covering which is generally aligned with and opposite the first stem opening so as to provide for the slightly extended, generally not fully inflated tip of the balloon to extend slightly outward from the second opening of the outer covering. The second opening is not usually required where a needle-inflated balloon is used. The employment of the stem and second opening and the alignment of the outer tip and the stem helps provide for stabilization and orientation of the inflated balloon within the outer covering. If desired, but not necessary, the second opening may have separate enclosures placed thereover for aesthetic appearances.

The recreational ball would include a securing means so that an elastic element may be secured to the recreational ball when it is employed for punch-type purposes, wherein the means to secure would not interfere with the use of the ball when it is separately used as a recreational play ball. Generally, the means to secure the elastic element would include a fabric or band or other loop means secured to the outer covering, but more generally and preferably secured generally adjacent or about or across the stem opening, and which may be composed preferably of a stretchable material like Lycra® to provide additional stretching in use, but also of a non-stretchable fabric type material.

The recreational play ball would also include an elastic element which is adapted to be secured to the ball securing means, so as and adapted to be held or grasped by the hand of a user and more typically comprised of a single strand or an elastic-type loop element, such as a rubber band, of desired shape, for example having a diameter of 6 to 12 or more inches, so that the loop element may be placed around the hand of a user and the other end secured to the securing means, thereby permitting the user to continually bounce in a repetitive manner the high bounce recreational play ball against the hand of a user. The high bounce characteristics of the recreational play ball, together with the elastic of the securing means and of the elastic loop element provides for rapid, reciprocal, bouncing movement against the hand of the user when the hand of the user is moved slightly in a repetitive, aligned manner. The elastic element may be tied, that is may be secured in a releasable or a nonreleasable manner, to the securing means or to the outer section of the outer covering, preferably as provided in a releasable manner and generally tied to the band or securing means. Typically, an elastic loop element, such as an elongated rubber or woven fabric band is employed, and wherein the band is inserted underneath the fabric band of the securing means and then looped over on itself to secure the elastic loop element to the band securing means.

It is often desirable and preferable that the elastic element be covered with a fabric-type material, and typically a stretchable fabric which may be the same or a different stretchable fabric as is used in the outer covering and having a stretchability the same or greater than the elastic element so as to contain the elastic loop element within the stretchable fabric without limiting the travel of the elastic element and to provide tension therefor and provide for a more fully integrated, color-acceptable elastic means.

In use, as desirable, the outer covering of the recreational play ball may be imprinted with various logos, design and indicia and even faces as desired, such as the faces of a character or person, generally opposite to the one opening such as about the first opening or about where the securing band is located, so that the repetitive bouncing of the recreational play ball is directed against the imprinted indicia on the covering, such as for example, a political figure, cartoon figure or the like.

The invention will be described for the purposes of illustration only in connection with certain illustrated embodiments; however, it is recognized that various modifications, changes improvements and additions may be made to the illustrated embodiments all falling within the spirit and scope of the invention.

DESCRIPTION OF THE EMBODIMENTS

Figure 1:
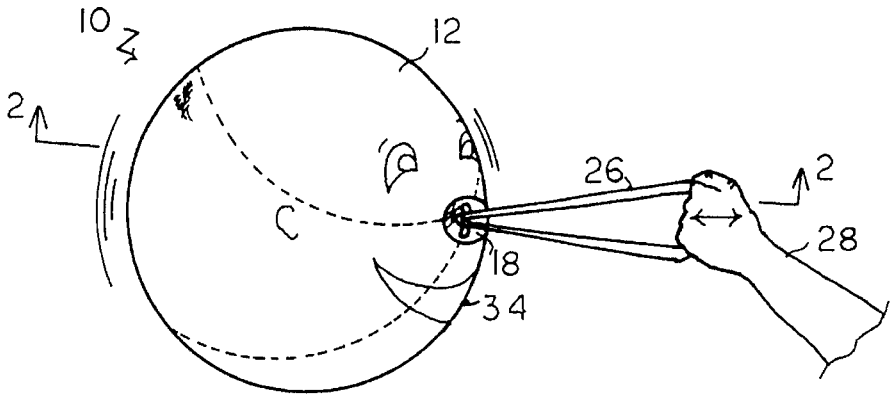
FIG. 1 is a perspective view of the recreational punch ball in use.

FIG. 1 shows the recreational punch ball 10 in use with the outer cover 12 encasing the balloon which is inflated to engage the cover and provide for a generally spherical shape with high bounce characteristics. The elastic loop with cover 26 is secured to the punch ball by inserting the loop through the securing band 30 secured to the fabric cover 12 and across the stem opening 18 and then looped over on itself to releasably secure the elastic loop to the band securing means. The other end of the fabric-covered elastic loop is held by the user's hand 28, which hand is then moved slightly in a repetitive, aligned manner to provide a rapid, reciprocal movement against the hand of the user. The ball is sufficiently inflated to provide for a taut, tight fit of the outer cover 12 to provide very high bounce characteristics of the punch ball. The fabric covering 12 comprises arcuate portions of a flexible, stretchable fabric stitched by sewing stitches 32 or otherwise secured together to form the outer cover. Printed faces 34 or other indicia can be affixed to the fabric outer cover so that the repetitive bouncing of the recreational punch ball is directed against the printed indicia.

Figure 2:
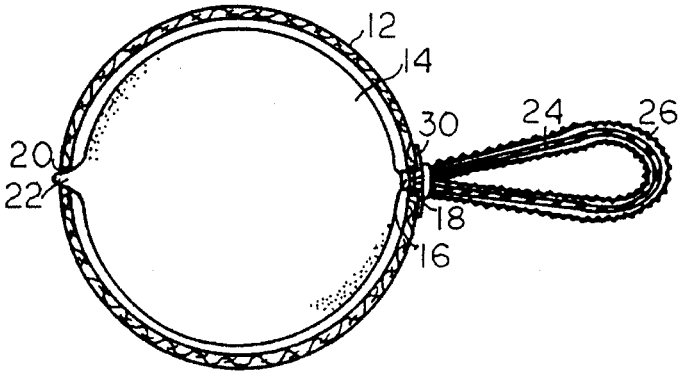
FIG. 2 is a side sectional view of the recreational punch ball of FIG. 1 along lines 2—2.

FIG. 2 illustrates a sectional side view of the recreational punch ball of FIG. 1 along the lines 2—2 with the outer cover 12 encasing an inflated balloon 14 with a closed stem 16 and an under-inflated tip 22 opposite the stem, which tip extends outwardly through a second opening 20 in the outer cover opposite the cover stem opening 18. The elastic loop 24, covered by a fabric elastic loop cover 26 is inserted through the securing band 30 which extends across the cover stem opening 18 and then looped over on itself to provide for a releasably secured elastic loop to be employed for use by the user's hand.

Figure 3:
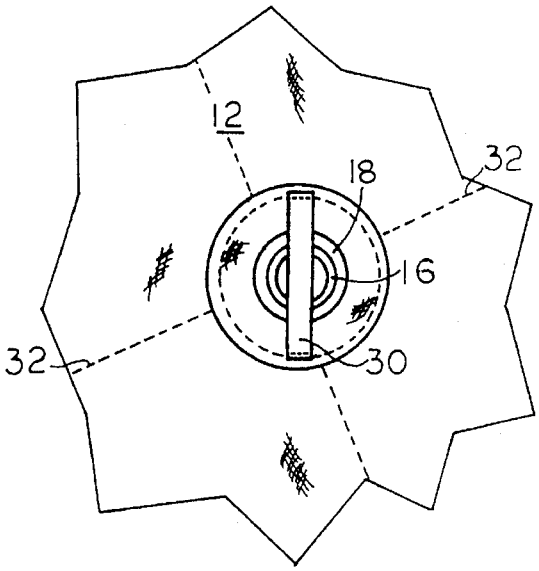
FIG. 3 is an enlarged, fragmentary, plan view of the stem opening of FIG. 1.

FIG. 3 is a fragmentary plan view of the fabric cover 12 with the cover stem opening 18 with the securing band 30 secured across the opening, showing the balloon stem 16 secured and tucked underneath the securing band in preparation for use as an inflatable ball or for the insertion of the fabric covered band for use as a recreational punch ball.

In a relaxed, non-operational mode, the stretchable fabric cover 26 will normally be pleated or in a relaxed, wrinkle-type state as illustrated in FIG. 2; and in use, as illustrated in FIG. 1, with the elastic element in a taut, elastic state.

What is claimed is:

1. A fluid inflatable recreational punch ball which comprises:

a) an outer covering formed of a stretchable, flexible fabric which comprises a fabric selected from the group consisting of spandex fiber, nylon fiber and combinations of spandex fiber and nylon fiber, which moves between an unstretched and an expanded, stretched spherical form which when fully expanded assumes a desired spherical ball configuration, said covering having a first opening therein to permit the insertion into the outer covering of an inflatable balloon in its uninflated state;

b) a balloon having a means for inflation and formed of a thin elastic material, which generally mimics the spherical form of the outer cover and which permits inflation of the balloon within the outer covering with the inflation means in the first opening to cause the balloon on substantially full inflation to engage the inner surface and to stretch slightly the outer covering to the desired recreational ball configuration and in the inflated state to impart desired bounce and weight properties to the recreational punch ball, with the inflatable balloon substantially fully encased by the stretched outer covering;

c) a securing means to secure an elastic element to the ball;

d) an elongated elastic element having a one end secured to the securing means and an other end adapted to be held by the hand of the recreational ball user; and e) a stretchable protective outer cover fabric material which substantially covers the length and exterior surface of the elastic element and is adapted to move between a relaxed and a stretched position in use, whereby the repeated movement of the hand of the user repeatedly bounces the recreational punch ball against the user's hand, utilizing the high bounce properties of the recreational punch ball and the elastic element secured to the ball.

2. The ball of claim 1 wherein the elastic element comprises a closed loop elastic element looped at one end about the securing means.

3. The ball of claim 1 wherein the stretchable outer covering comprises a blend of nylon and spandex fibers.

4. The ball of claim 1 wherein the elastic element comprises an elastic band or a stretchable woven fabric material.

5. The ball of claim 1 wherein the inflation means comprises a fluid passage stem which projects through the first opening for fluid inflation and after inflation the stem is sealed within the first opening.

6. The ball of claim 1 wherein the outer covering is formed of a plurality of separate, sewn together stretchable fabric panels comprised of arcuate, trapezoidal pieces.

7. The ball of claim 1 wherein the securing means comprises a band extending across the first opening.

8. The ball of claim 7 wherein the securing means comprises a stretchable woven fabric band.

9. The ball of claim 1 wherein the elastic element comprises an elastic loop element composed of a thin rubber or woven stretchable fabric material and having a general diameter ranging from about 6 to 12 inches.

10. The ball of claim 1 wherein the securing means comprises a loop-type band across the opening and wherein the elastic element comprises an elastic loop element covered by a stretchable material, and which is releasably looped about and secured to the band.

11. The ball of claim 1 wherein the outer covering includes a second opening generally opposite and aligned with the first opening and wherein the means of inflation includes a stem and the balloon has a slightly extended tip on inflation opposite the stem, and which tip on inflation fits into the second opening of the outer covering and the stem into the first opening.

12. The ball of claim 1 which includes indicia on the outer covering to provide for visible indicia in the stretched condition of the outer covering.

13. The ball of claim 1 which is inflated with water and has a diameter of about 3 to 6 inches.

14. The ball of claim 1 which is in a substantially fully inflated, spheroidal condition.

15. A fluid inflatable recreational punch ball which comprises:

a) an outer covering formed of a stretchable, flexible fabric material which moves between an unstretched form to an expanded, stretched sphere form, which comprises a fabric selected from the group consisting of spandex fiber, a nylon fiber and combinations of spandex fiber and nylon fiber, which covering is composed of a plurality of separate, sewn together fabric panels composed of arcuate, trapezoidal pieces secured together at the ends, and which covering when fully expanded assumes a desired spherical ball configuration, said covering having a first opening therein to permit insertion into the outer covering of an inflatable balloon in its uninflated state;

b) a balloon having a stem means for inflating the balloon and formed of a thin elastic material which generally mimics the sphere form of the outer covering and which permits inflation of the balloon within the outer covering, the stem means in the first opening to cause the balloon on substantially full inflation to engage the inner surface and to stretch slightly the outer covering to the desired recreational ball sphere configuration and in the inflated state to impart desired bounce and weight to the recreational ball with the inflated balloon substantially fully encased by the stretched outer covering;

c) a securing means extending across or about the first opening to secure an elastic element to the ball; and d) an elongated elastic element having a one end secured to the securing means and another end adapted to be held by the hand of the recreational ball user, whereby with the repeated movements of the hand by the user repeatedly bounces the recreational ball against the user's hand, utilizing the high bounce properties of the recreational punch ball and the elastic element secured to the ball.

16. The ball of claim 15 which includes a stretchable outer cover fabric material which substantially covers the length and exterior surface of the elongated elastic element and is adapted to move between a relaxed and a stretched position.

17. The ball of claim 15 which includes a second opening in the outer covering generally opposite and aligned with the first opening, and wherein the balloon includes a slightly extended tip in placement opposite the stem and which tip on inflation fits into the second opening of the outer cover of the stem in the first opening.

* * * * *